US007401650B2

(12) United States Patent
MacKenzie

(10) Patent No.: US 7,401,650 B2
(45) **Date of Patent: *Jul. 22, 2008**

(54) APPARATUS AND METHODS FOR RADIALLY EXPANDING A TUBULAR MEMBER

(75) Inventor: Alan MacKenzie, Aberdeen (GB)

(73) Assignee: E2 Tech Limited, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/682,746

(22) Filed: Mar. 6, 2007

(65) Prior Publication Data

US 2007/0199719 A1 Aug. 30, 2007

Related U.S. Application Data

(63) Continuation of application No. 10/475,626, filed as application No. PCT/GB02/01848 on Apr. 19, 2002, now Pat. No. 7,185,701.

(30) Foreign Application Priority Data

Apr. 20, 2001 (GB) ..... 0109711.2

(51) Int. Cl.
*E21B 29/00* (2006.01)

(52) U.S. Cl. ..... 166/297; 166/55; 166/207; 166/380

(58) Field of Classification Search ..... 166/297, 166/55, 207, 380
See application file for complete search history.

(56) References Cited

U.S. PATENT DOCUMENTS 3,712,376 A * 1/1973 Owen et al. ..... 166/277
6,029,748 A * 2/2000 Forsyth et al. ..... 166/380
7,185,701 B2 * 3/2007 Mackenzie ..... 166/297

* cited by examiner

*Primary Examiner*—William P Neuder
(74) *Attorney, Agent, or Firm*—Patterson & Sheridan, L.L.P.

(57) ABSTRACT

Radially expanding a tubular such as a liner or casing, especially in a downward direction. The apparatus includes at least one driver device such as a piston that is typically fluid-actuated, and an expander device is attached to the or each driver device. Actuation of the or each driver device causes movement of the expander device to expand the tubular. One or more anchoring devices, which may be radially offset, are used to substantially prevent the tubular from moving during expansion thereof.

22 Claims, 5 Drawing Sheets

Section I-I

Section II-II

APPARATUS AND METHODS FOR RADIALLY EXPANDING A TUBULAR MEMBER

CROSS-REFERENCE TO RELATED APPLICATIONS

This application is a continuation of U.S. patent application Ser. No. 10/475,626, filed Mar. 22, 2004, now U.S. Pat. No. 7,185,701, which claims benefit of PCT International Application No. PCT/GB02/01848, filed Apr. 19, 2002, which claims benefit of British Application Serial No. 0109711.2, filed on Apr. 20, 2001. Each of the aforementioned related patent applications is herein incorporated by reference in its entirety.

BACKGROUND OF THE INVENTION

1. Field of the Invention

The present invention relates to apparatus and methods that are particularly, but not exclusively, suited for radially expanding tubulars in a borehole or wellbore. It will be noted that the term "borehole" will be used herein to refer also to a wellbore.

2. Description of the Related Art

It is known to use an expander device to expand at least a portion of a tubular member, such as a liner, casing or the like, to increase the inner and outer diameters of the member. Use of the term "tubular member" herein will be understood as being a reference to any of these and other variants that are capable of being radially expanded by the application of a radial expansion force, typically applied by the expander device, such as an expansion cone.

The expander device is typically pulled or pushed through the tubular member to impart a radial expansion force thereto in order to increase the inner and outer diameters of the member. Conventional expansion processes are generally referred to as "bottom-up" in that the process begins at a lower end of the tubular member and the cone is pushed or pulled upwards through the member to radially expand it. The terms "upper" and "lower" shall be used herein to refer to the orientation of a tubular member in a conventional borehole. The terms being construed accordingly where the borehole is deviated or a lateral borehole for example. "Lower" generally refers to the end of the member that is nearest the formation or pay zone.

The conventional bottom-up method has a number of disadvantages, and particularly there are problems if the expander device becomes stuck within the tubular member during the expansion process. The device can become stuck for a number of different reasons, for example due to restrictions or protrusions in the path of the device.

In addition to this, there are also problems with expanding tubular members that comprise one or more portions of member that are provided with perforations or slots ("perforated"), and one or more portions that are not provided with perforations or slots ("non-perforated"), because the force required to expand a perforated portion is substantially less than that required to expand a non-perforated portion. Thus, it is difficult to expand combinations of perforated and non-perforated tubular members using the same expander device and method.

Some methods of radial expansion use hydraulic force to propel the cone, where a fluid is pumped into the tubular member down through a conduit such as drill pipe to an area below the cone. The fluid pressure then acts on a lower surface of the cone to provide a propulsion mechanism. It will be appreciated that a portion of the liner to be expanded defines a pressure chamber that facilitates a build up of pressure below the cone to force it upwards and thus the motive power is applied not only to the cone, but also to the tubular member that is to be expanded. It is often the case that the tubular members are typically coupled together using screw threads and the pressure in the chamber can cause the threads between the portions of tubular members to fail. Additionally, the build up of pressure in the pressure chamber can cause structural failure of the member due to the pressure within it if the pressure exceeds the maximum pressure that the material of the member can withstand. If the material of the tubular bursts or the thread fails, the pressure within the pressure chamber is lost, and it is no longer possible to force the cone through the member using fluid pressure.

Also, in the case where the cone is propelled through the liner using fluid pressure, where the outer diameter of the tubular member decreases, the surface area of the cone on which the fluid pressure can act is reduced accordingly because the size of the expander device must be in proportion to the size of the tubular member to be expanded.

SUMMARY OF THE INVENTION

According to a first aspect of the present invention, there is provided apparatus for radially expanding a tubular, the apparatus comprising one or more driver devices coupled to an expander device, and one or more anchoring devices engageable with the tubular, wherein the driver device causes movement of the expander device through the tubular to radially expand it whilst the anchoring device prevents movement of the tubular during expansion.

In this embodiment, the or each anchoring device optionally provides a reaction force to the expansion force generated by the or each driver.

According to a second aspect of the present invention, there is provided apparatus for radially expanding a tubular, the apparatus comprising one or more driver devices coupled to an expander device, and one or more anchoring devices engageable with the tubular, wherein the or each driver device causes movement of the expander device through the tubular to radially expand it whilst the anchoring device provides a reaction force to the expansion force generated by the or each driver device.

In this embodiment, at least one anchoring device optionally prevents movement of the tubular during expansion.

According to a third aspect of the present invention, there is provided a method of expanding a tubular, the method comprising the step of actuating one or more driver devices to move an expander device within the tubular to radially expand the member.

BRIEF DESCRIPTION OF THE DRAWINGS

Embodiments of the present invention shall now be described, by way of example only, with reference to the accompanying drawings, in which.

DETAILED DESCRIPTION

Figure 1:
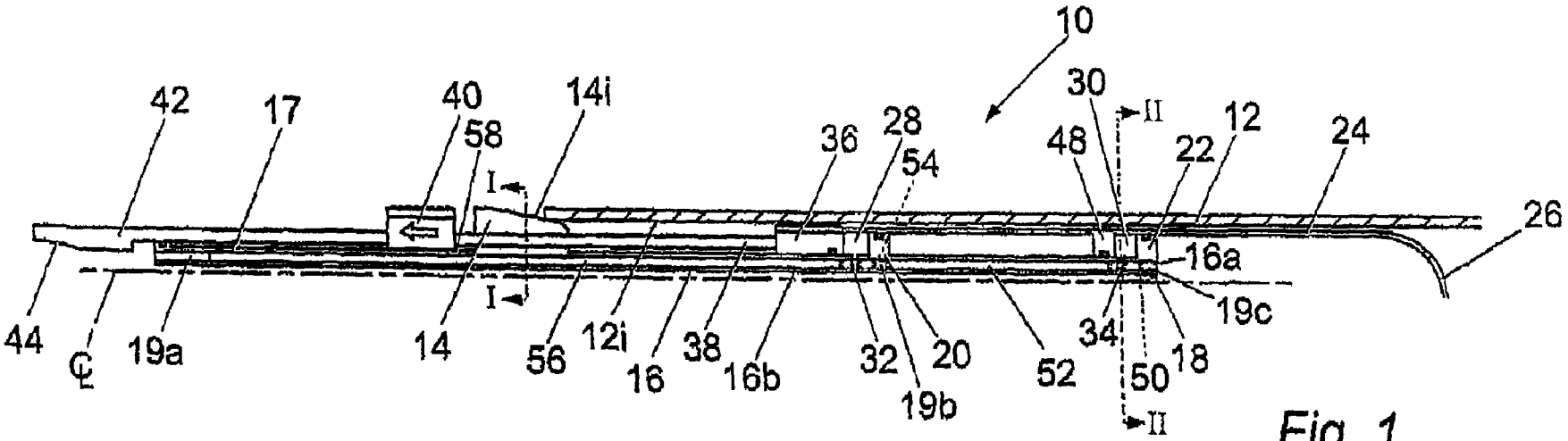
FIG. 1 is a longitudinal part cross-sectional view of an exemplary embodiment of apparatus for expanding a tubular member.

The invention also provides apparatus for radially expanding a tubular, the apparatus comprising one ore more driver devices that are coupled to an expander device, where fluid collects in a fluid chamber and acts on the or each driver device to move the expander device.

The invention further provides a method of radially expanding a tubular, the method comprising the steps of applying pressurized fluid to one ore more driver devices that are coupled to an expander device, where fluid collects in a fluid chamber and acts on the or each driver device to move the expander device.

This particular embodiment has advantages in that the pressurized fluid acts directly on the or each driver device and not on the tubular itself.

The or each driver device is typically a fluid-actuated device such as a piston. The piston(s) can be coupled to the expander device by any conventional means. Two or more pistons are typically provided. The pistons typically being coupled in series. Thus, additional expansion force can be provided by including additional pistons. The or each piston is typically formed by providing an annular shoulder on a sleeve. The expander device is typically coupled to the sleeve.

Optionally, one or more expander devices may be provided. Thus, the tubular can be radially expanded in a stepwise manner. That is, a first expander device radially expands the inner and outer diameters of the member by a certain percentage, a second expander device expands by a further percentage, and so on.

The sleeve is typically provided with ports that allow fluid from a bore of the sleeve to pass into a fluid chamber or piston area on one side of the or each piston. Thus, pressurized fluid can be delivered to the fluid chamber or piston area to move the or each piston.

The sleeve is typically provided with a ball seat. The ball seat allows the bore of the sleeve to be blocked so that fluid pressure can be applied to the pistons via the ports in the sleeve.

The fluid chamber or piston area is typically defined between the sleeve and an end member. Thus, pressurized fluid does not act directly on the tubular. This is advantageous as the fluid pressure required for expansion may cause the material of the tubular to stretch or burst. Additionally, the tubular may be a string of tubular members that are threadedly coupled together, and the fluid pressure may be detrimental to the threaded connections.

The or each anchoring device is typically a one-way anchoring device. The anchoring device(s) can be, for example, a BALLGRA™ manufactured by BSW Limited. The or each anchoring device is typically actuated by moving at least a portion of it in a first direction. The anchoring device is typically de-actuated by moving said portion in a second direction, typically opposite to the first direction.

The or each anchoring device typically comprises a plurality of ball bearings that engage in a taper. Movement of the taper in the first direction typically causes the balls to move radially outward to engage the tubular. Movement of the taper in the second direction typically allows the balls to move radially inward and thus disengage the tubular.

Two anchoring devices are typically provided. One of the anchoring devices is typically laterally offset with respect to the other anchoring device. A first anchoring device typically engages portions of the tubular that are unexpanded, and a second anchoring device typically engages portions of the tubular that have been radially expanded. Thus, at least one anchoring device can be used to grip the tubular and retain it on the apparatus as it is being run into the borehole and also during expansion of the member.

The apparatus is typically provided with a fluid path that allows trapped fluid to bypass the apparatus. Thus, fluids trapped at one end of the apparatus can bypass it to the other end of the apparatus.

The expander device typically comprises an expansion cone. The expansion cone can be of any conventional type and can be made of any conventional material (e.g. steel, steel alloy, tungsten carbide, etc.). The expander device is typically of a material that is harder than the tubular that it has to expand. It will be appreciated that only the portion(s) of the expander device that contacts the tubular need be of the harder material.

The apparatus typically includes a connector for coupling the apparatus to a string. The connector typically comprises a box connection, but any conventional connector may be used. The string typically comprises a drill string, coiled tubing string, production string, wireline, or the like.

The tubular typically comprises liner, casing, drill pipe, etc., but may be any downhole tubular that is of a ductile material and/or is capable of sustaining plastic and/or elastic deformation. The tubular may be a string of tubulars (e.g. a string of individual lengths of liner that have been coupled together).

The step of moving the piston(s) typically comprises applying fluid pressure thereto.

The method typically includes the additional step of gripping the tubular during expansion. The step of gripping the tubular typically comprises actuating one or more anchoring devices to grip the tubular.

The method optionally includes one, some or all of the additional steps of a) reducing the fluid pressure applied to the pistons; b) releasing the or each anchoring device; c) moving the expander device to an unexpanded portion of the tubular; d) actuating the or each anchoring device to grip the tubular; and e) increasing the fluid pressure applied to the pistons to move the expander device to expand the tubular.

The method optionally includes repeating steps a) to e) above until the entire length of the tubular is expanded.

Referring to the drawings, there is shown an exemplary embodiment of apparatus 10 that is particularly suited for radially expanding a tubular member 12 within a borehole (not shown). FIG. 1 shows the apparatus 10 in part cross-section and it will be appreciated that the apparatus 10 is symmetrical about the centre line C.

The tubular member 12 that is to be expanded can be of any conventional type, but it is typically of a ductile material so that it is capable of being plastically and/or elastically expanded by the application of a radial expansion force. Tubular member 12 may comprise any downhole tubular such as drill pipe, liner, casing, or the like, and is typically of steel, although other ductile materials may also be used.

The apparatus 10 includes an expansion cone 14 that may be of any conventional design or type. For example, the cone 14 can be of steel or an alloy of steel, tungsten carbide, ceramic, or a combination of these materials. The expansion cone 14 is typically of a material that is harder than the material of the tubular member 12 that it has to expand. However, this is not essential as the cone 14 may be coated or otherwise provided with a harder material at the portions that contact the tubular 12 during expansion.

The expansion cone 14 is provided with an inclined face **14*i* that is typically annular and is inclined at an angle of around 200 with respect to the centre line C of the apparatus 10. The inclination of the inclined face 14*i*** can vary from around 5° to 45°, but it is found that an angle of around 15° to 25° gives the best performance. This angle provides sufficient expansion without causing the material to rupture and without providing high frictional forces.

The expansion cone 14 is attached to a first tubular member 16 which in this particular embodiment comprises a portion of coil tubing, although drill pipe, etc. may be used. A first end 16*a* of the coil tubing is provided with a ball catcher in the form of a ball seat 18. The purpose of which is to block a bore 16*b* in the coil tubing 16 through which fluid may pass.

The coiled tubing 16 is attached to a second tubular member in the form of a sleeve 17 using a number of annular spacers 19*a*, 19*b*, 19*c*. The spacers 19*b* and 19*c* create a first conduit 52 therebetween, and the spacers 19*a*, 19*b* create a second conduit 56 therebetween. The spacer 19*c* is provided with a port 50 and spacer 19*b* is provided with a port 54, both ports 50, 54 allowing fluid to pass therethrough. The function of the ports 50, 54 and the conduits 52, 56 shall be described below.

Two laterally-extending annular shoulders are attached to the sleeve 17 and sealingly engage a cylindrical end member 24, the annular shoulders forming first and second pistons 20, 22, respectively. The cylindrical end member 24 includes a closed end portion 26 at a first end thereof. The engagement of the first and second pistons 20, 22 with the cylindrical end member 24 provides two piston areas 28, 30 in which fluid (e.g. water, brine, drill mud, etc.) can be pumped into via vents 32, 34 from the bore 16*b*. The annular shoulders forming the first and second pistons 20, 22 can be sealed to the cylindrical end member 24 using any conventional type of seal (e.g. O-rings, lip-type seals, or the like).

The two piston areas 28, 30 typically have an area of around 15 square inches, although this is generally dependent upon the dimensions of the apparatus 10 and the tubular member 12, and also the expansion force that is required.

A second end of the cylindrical end member 24 is attached to a first anchoring device 36. The first anchoring device 36 is typically a BALLGRA™ that is preferably a one-way anchoring device and is supplied by BSW Limited. The BALLGRA™ works on the principle of a plurality of balls that engage in a taper. Applying a load to the taper in a first direction acts to push the balls radially outwardly and thus they engage an inner surface 12*i* of the tubular 12 to retain it in position. The gripping motion of the BALLGRAB™ can be released by moving the taper in a second direction, typically opposite to the first direction, so that the balls disengage the inner surface 12*i*.

The weight of the tubular member 12 can be carried by the first anchoring device 36 as the apparatus 10 is being run into the borehole, but this is not the only function that it performs, as will be described. The first anchoring device 36 is typically a 7 inch (approximately 178 mm), 29 pounds per foot type, but the particular size and rating of the device 36 that is used generally depends upon the size, weight, and like characteristics of the tubular member 12.

Figure 2:
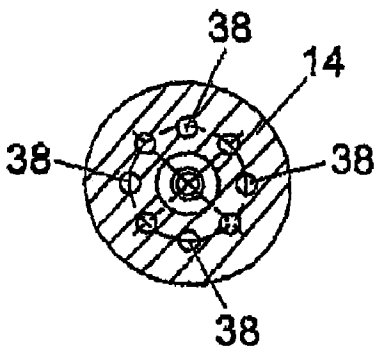
FIG. 2 is a cross-sectional view through the apparatus of FIG. 1 along line I-I in FIG. 1.

The first anchoring device 36 is coupled via a plurality of circumferentially spaced-apart rods 38 (see FIG. 2 in particular) to a second anchoring device 40 that in turn is coupled to a portion of conveying pipe 42. The second anchoring device 40 is typically of the same type as the first anchoring device 36, but could be different as it is not generally required to carry the weight of the member 12 as the apparatus 10 is run into the borehole.

The conveying pipe 42 can be of any conventional type, such as drill pipe, coil tubing, or the like. The conveying pipe 42 is provided with a connection 44 (e.g. a conventional box connection) so that it can be coupled into a string of, for example drill pipe, coiled tubing, etc. (not shown). The string is used to convey the apparatus 10 and the tubular member 12.

The second anchoring device 40 is used to grip the tubular member 12 after it has been radially expanded and is typically located on a longitudinal axis that is laterally spaced-apart from the axis of the first anchoring device 36. This allows the second anchoring device 40 to engage the increased diameter of the member 12 once it has been radially expanded.

Referring now to FIGS. 4 to 7, the operation of apparatus 10 shall now be described.

A ball 46 (typically a ¾ inch, approximately 19 mm ball) is dropped or pumped down the bore of the string to which the conveying pipe 42 is attached, and thereafter down through the bore 16*b* of the coil tubing 16 to engage the ball seat 18. The ball 46 therefore blocks the bore 16*b* in the conventional manner. Thereafter, the bore 16*b* is pressured-up by pumping fluid down through the bore 16*b*, typically to a pressure of around 5000 psi. The ball seat 18 can be provided with a safety-release mechanism (e.g. one or more shear pins) that will allow the pressure within bore 16*b* to be reduced in the event that the apparatus 10 fails. Any conventional safety-release mechanism can be used.

Figure 4:
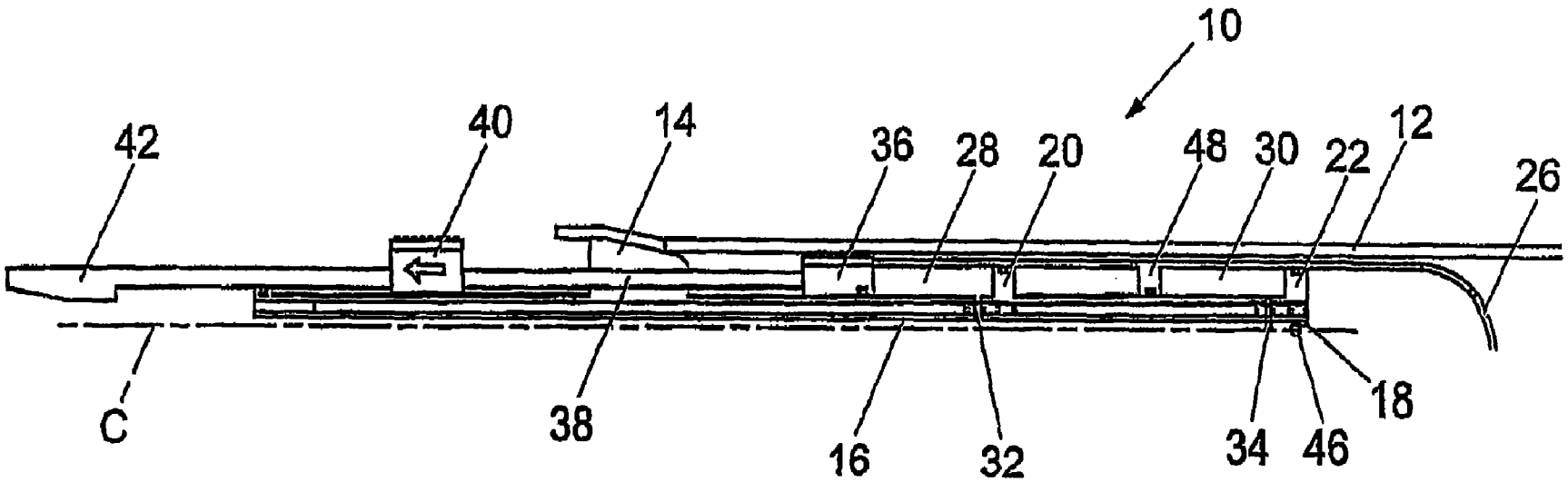
FIGS. 4 to 7 show a similar view of the apparatus of FIG. 1 in various stages of operation thereof.

The pressurized fluid enters the piston areas 28, 30 through the vents 32, 34, respectively, and acts on the pistons 20, 22. The fluid pressure at the piston areas 28, 30 causes the coil tubing 16, sleeve 17, and thus the expansion cone 14 to move to the right in FIG. 4 (e.g. downwards when the apparatus 10 is orientated in a conventional borehole) through the tubular member 12 to radially expand the inner and outer diameters thereof, as illustrated in FIG. 4.

During movement of the pistons 20, 22, slight tension is applied to the conveying pipe 42 via the drill pipe or the like to which the apparatus 10 is attached so that the first anchoring device 36 grips the tubular member 12 to retain it in position during the expansion process. Thus, the first anchoring device 36 can be used to grip the tubular member 12 as the apparatus 10 is run into the borehole and can also be used to grip and retain the tubular member 12 in place during at least a part of the expansion process.

Figure 5:
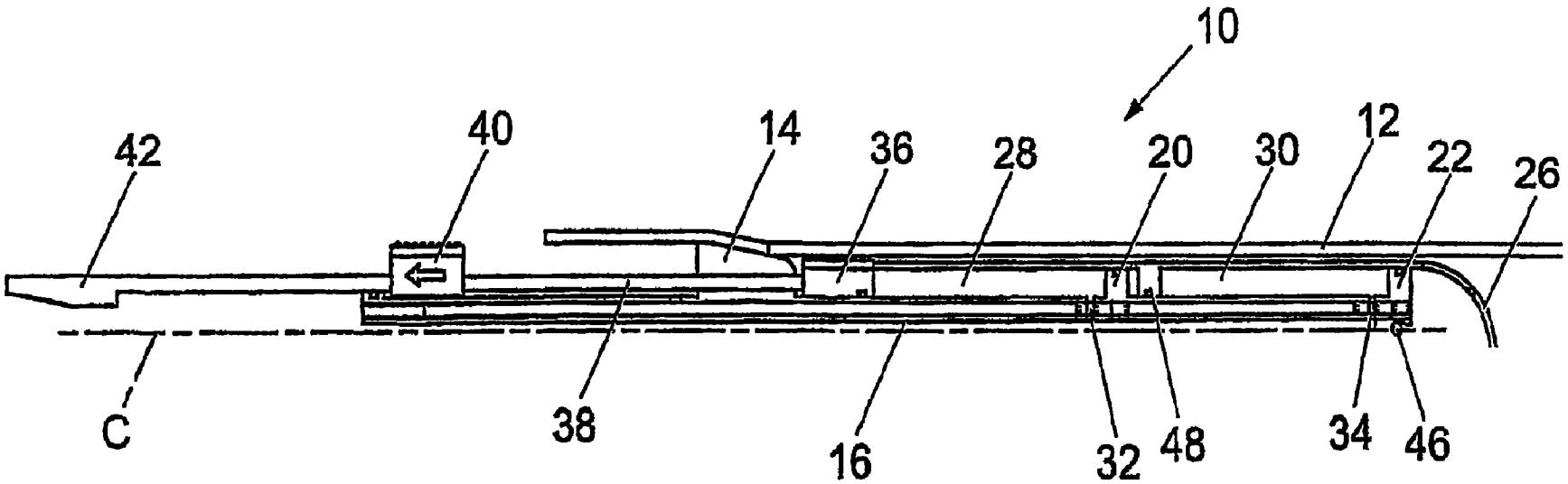

Continued application of fluid pressure through the vents 32, 34 into the piston areas 28, 30 causes the pistons 20, 22 to move to the position shown in FIG. 5, where an annular shoulder 48 that extends from the cylindrical end member 24 defines a stop member for movement of the piston 20 (and thus piston 22). Thus, the pistons 20, 22 have extended to their first stroke as defined by the annular shoulder 48. The length of stroke of the pistons 20, 22 can be anything from around 5 ft (approximately 1 and a half meters) to around 30 ft (around 6 meters), but this is generally dependant upon the rig handling capability and the length of member 12. The length of the stroke of the pistons 20, 22 can be chosen to suit the particular application and may extend outwith the range quoted.

Figure 6:
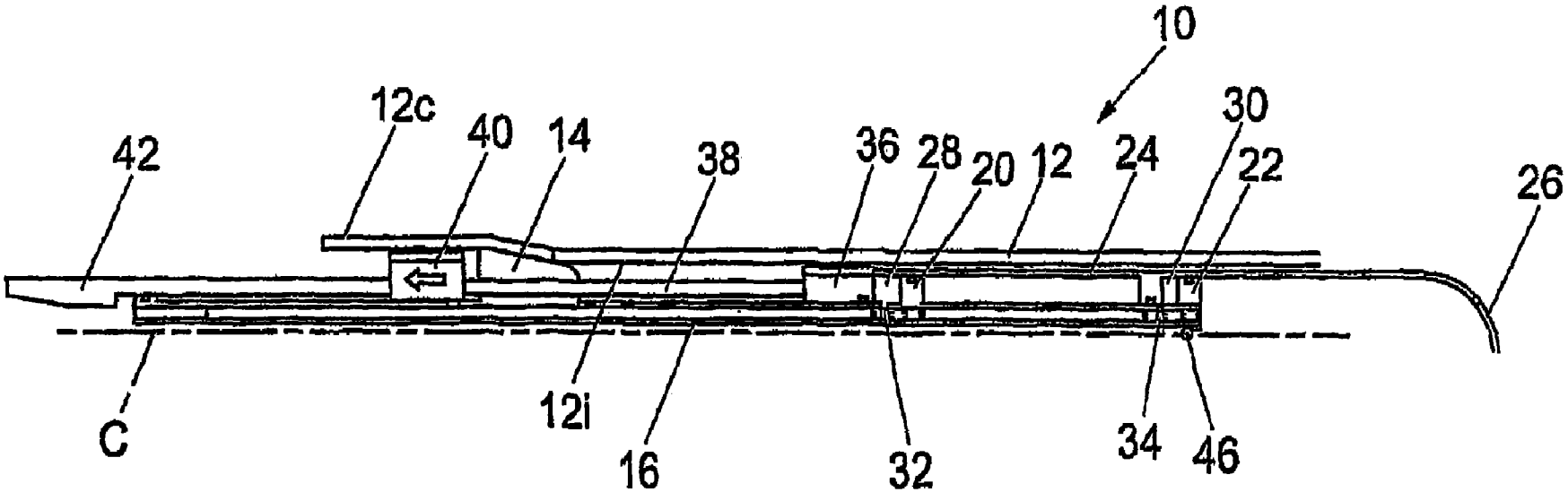

Once the pistons 20, 22 have reached their first stroke, the slight upward force applied to the conveying pipe 42 is released so that the first anchoring device 36 disengages the inner surface 12*i* of the tubular member 12. Thereafter, the conveying pipe 42 and the anchoring device 36, 40 and end member 24 are moved to the right as shown in FIG. 6 (e.g. downwards). This can be achieved by lowering the string to which the conveying pipe 42 is attached.

The second anchoring device 40 is positioned laterally outwardly of the first anchoring device 36 so that it can engage the expanded portion 12*e* of the tubular member 12. Thus, the tubular member 12 can be gripped by both the first and second anchoring devices 36, 40, as shown in FIG. 6.

Figure 7:
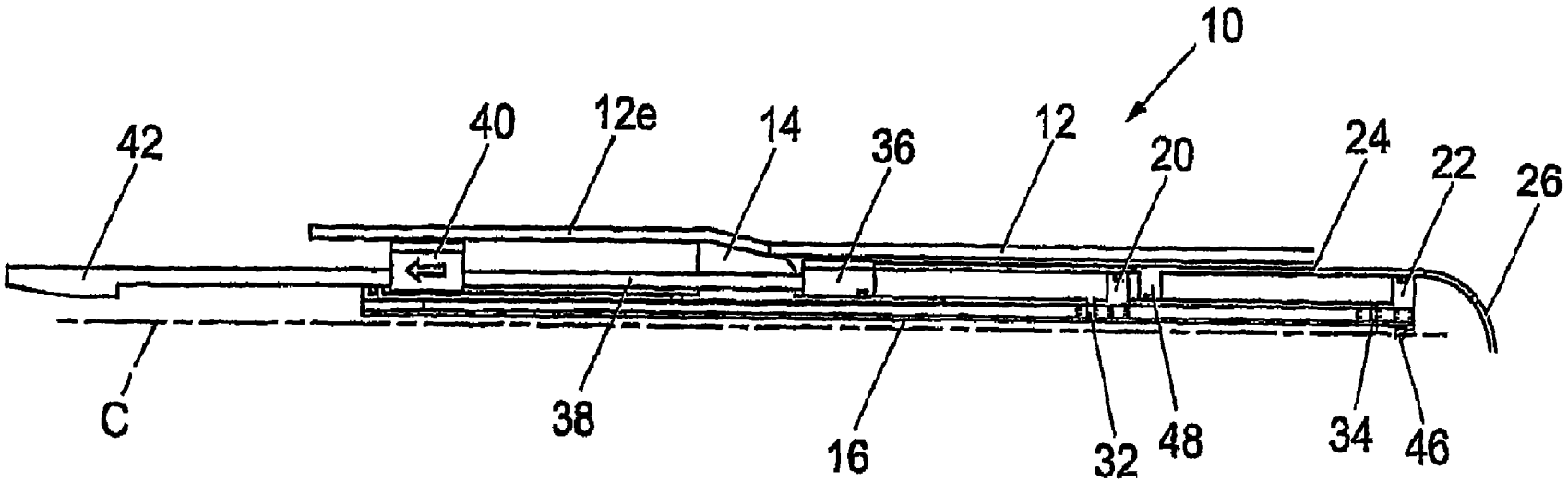

With the apparatus 10 in the position shown in FIG. 6, tension is then applied to the conveying pipe 42 so that the first and second anchoring devices 36, 40, are actuated to grip the inner surface 12*i* of the member 12 and fluid pressure (at around 5000 psi) is then applied to the bore 16*b* to extend the pistons 20, 22. Fluid pressure is continually applied to the pistons 20, 22 via vents 32, 34 to extend them through their next stroke to expand a further portion of the tubular member 12, as shown in FIG. 7.

This process is then repeated by releasing the tension on the conveying pipe 42 to release the first and second anchoring devices 36, 40 moving them downwards and then placing the conveying pipe 42 under tension again to engage the anchoring devices 36, 40 with the member 12. The pressure in the bore 16*b* is then increased to around 5000 psi to extend the pistons 20, 22 over their next stroke to expand a further portion of the tubular member 12.

The process described above with reference to FIGS. 5 to 7 is continued until the entire length of the member 12 has been radially expanded. The second anchoring device 40 ensures that the entire length of the member 12 can be expanded by providing a means to grip the member 12. The second anchoring device 40 is typically required as the first anchoring device 36 will eventually pass out of the end of the member 12 and cannot thereafter grip it. However, expansion of the member 12 into contact with the borehole wall (where appropriate) may be sufficient to prevent or restrict movement of the member 12. A friction and/or sealing material (e.g. a rubber) can be applied at axially spaced-apart locations on the outer surface of the member 12 to increase the friction between the member 12 and the wall of the borehole. Further, cement can be circulated through the apparatus 10 prior to the expansion of member 12 (as described below) so that the cement can act as a partial anchor for the member 12 during and/or after expansion.

Apparatus 10 can be easily pulled out of the borehole once the member 12 has been radially expanded.

Embodiments of the present invention provide significant advantages over conventional methods of radially expanding a tubular member. In particular, certain embodiments provide a top-down expansion process where the expansion begins at an upper end of the member 12 and continues down through the member. Thus, if the apparatus 10 becomes stuck, it can be easily pulled out of the borehole without having to perform a fishing operation. The unexpanded portions of the tubular 12 are typically below the apparatus 10 and do not prevent retraction of the apparatus 10 from the borehole, unlike conventional bottom-up methods. This is particularly advantageous as the recovery of the stuck apparatus 10 is much simpler and quicker. Furthermore, it is less likely that the apparatus 10 cannot be retrieved from the borehole, and thus it is less likely that the borehole will be lost due to a stuck fish. The unexpanded portion can be milled away (e.g. using an over-mill) so that it does not adversely affect the recovery of hydrocarbons or a new or repaired apparatus can be used to expand the unexpanded portion if appropriate.

Also, conventional bottom-up methods of radial expansion generally require a pre-expanded portion in the tubular member 12 in which the expander device is located before the expansion process begins. It is not generally possible to fully expand the pre-expanded portion and, in some instances, the pre-expanded portion can restrict the recovery of hydrocarbons as it produces a restriction (i.e. a portion of reduced diameter) in the borehole. However, the entire length of the member 12 can be fully expanded with apparatus 10.

The purpose of the pre-expanded portion on conventional methods is typically to house the expansion cone as the apparatus is being run into the borehole. In certain embodiments of the invention, an end of the tubular member 12 rests against the expansion cone 14 as it is being run into the borehole, but this is not essential as the first anchoring device 36 can be used to grip the member 12 as apparatus 10 is run in. Thus, a pre-expanded portion is not required.

The apparatus 10 is a mechanical system that is driven hydraulically, but the material of the tubular member 12 that has to be expanded is not subjected to the expansion pressures during conventional hydraulic expansion as no fluid acts directly on the tubular member 12 itself, but only on the pistons 20, 22 and the cylindrical end member 24. Thus, the expansion force required to expand the tubular member 12 is effectively de-coupled from the force that operates the apparatus 10.

Also in conventional systems, the movement of the expansion cone 14 is coupled to the drill pipe or the like in that the drill pipe or the like is typically used to push or pull the expansion cone through the member that is to be expanded. However with the apparatus 10, the movement of the expansion cone 14 is substantially de-coupled from movement of the drill pipe, at least during movement of the cone 14 during expansion. This is because the movement of the pistons 20, 22 by hydraulic pressure causes movement of the expansion cone 14, Movement of the drill pipe or the like to which the conveying pipe 42 is coupled has no effect on the expansion process, other than to move certain portions of the apparatus 10 within the borehole.

If higher expansion forces are required, then additional pistons can be added to provide additional force to move the expansion cone 14 and thus provide additional expansion forces. The additional pistons can be added in series to provide additional expansion force. Thus, there is no restriction on the amount of expansion force that can be applied as further pistons can be added. The only restriction would be the overall length of the apparatus 10. This is particularly useful where the liner, casing, and cladding are made of chrome as this generally requires higher expansion forces. Also, the connectors between successive portions of liner and casing, etc. that are of chrome are critical, and as this material is typically very hard, it requires higher expansion forces.

The apparatus 10 can be used to expand small sizes of tubular member 12 (API grades) up to fairly large diameter members, and can also be used with lightweight pipe, with a relatively small wall thickness (of less that 5 mm), and on tubulars having a relatively large wall thicknesses.

Furthermore, the hydraulic fluid that is used to move the pistons 20, 22 can be recycled and is thus not lost into the formation. Conventional expansion methods using hydraulic or other motive powers can cause problems with "squeeze" where fluids in the borehole that are used to propel the expander device, force fluids in the borehole below the device back into the formation, which can cause damage to the formation and prevent it from producing hydrocarbons.

However, the hydraulic fluid that is used to drive the pistons 20, 22 is retained within the apparatus 10 by the hall 46, and thus will not adversely effect the formation or pay zone.

In addition to this, apparatus 10 is provided with a path through which fluid that may be trapped below the apparatus 10 (that is fluid that is to the right of the apparatus 10 in FIG. 1) can flow through the apparatus 10 to the annulus above it (to the left in FIG. 1).

Figure 3:
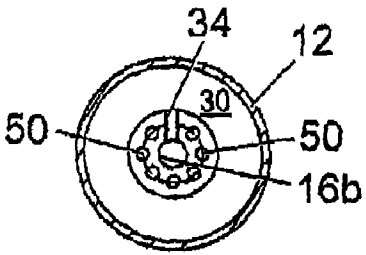
FIG. 3 is a cross-sectional view through the apparatus of FIG. 1 along line II-II in FIG. 1.

Referring to FIGS. 1 and 3 in particular, this is achieved by providing one or more circumferentially spaced apart ports 50 that allow fluid to travel through the spacer 19*c* and into the annular conduit 52, through the ports 54 in the spacer 19*b* into the second conduit 56, and then out into the annulus through a vent 58. Thus, fluid from below the apparatus 10 can be vented to above the apparatus 10, thereby reducing the possibility of damage to the formation or pay zone, and also substantially preventing the movement of the apparatus 10 from being arrested due to trapped fluids.

Additionally, the apparatus 10 can be used to circulate fluids before the ball 46 is dropped into the ball seat 18, and thus cement or other fluids can be circulated before the tubular member 12 is expanded. This is particularly advantageous as cement could be circulated into the annulus between the member 12 and the liner or open borehole that the member 12 is to engage, to secure the member 12 in place.

It will also be appreciated that a number of expansion cones 14 can be provided in series so that there is a step-wise expansion of the member 12. This is particularly useful where the member 12 is to be expanded to a significant extent, and the force required to expand it to this extent is significant and cannot be produced by a single expansion cone. Although the required force may be achieved by providing additional pistons (e.g. three or more), there may be a restriction in the overall length of the apparatus 10 that precludes this.

The apparatus 10 can be used to expand portions of tubular that are perforated and portions that are non-perforated. This is because the pressure applied to the pistons 20, 22 can be increased or decreased to provide for a higher or lower expansion force. Thus, apparatus 10 can be used to expand sand screens and strings of tubulars that include perforated and non-perforated portions.

Embodiments of the present invention provide advantages over conventional methods and apparatus in that the apparatus can be used with small sizes of tubulars. The force required to expand small tubulars can be high, and this high force cannot always be provided by conventional methods because the size of the tubular reduces the amount of force that can be applied, particularly where the cone is being moved by hydraulic pressure. However, embodiments of the present invention can overcome this because the expansion force can be increased by providing additional pistons.

Modifications and improvements may be made to the foregoing without departing from the scope of the present invention. For example, it will be appreciated that the term "borehole" can refer to any hole that is drilled to facilitate the recovery of hydrocarbons, water or the like.

The invention claimed is:

1. An expansion device for radially expanding a tubular in a wellbore comprising:
- a resetable anchor that is resettable downhole;
- an expansion cone moveably coupled to the anchor; and
- an actuator configured to move the expansion cone relative to the anchor, thereby moving the expansion cone in the tubular in order to radially expand the tubular.

2. The expansion device of claim 1, wherein the actuator is fluid operated.

3. The expansion device of claim 2, wherein the actuator is a piston and cylinder.

4. The expansion device of claim 1, further comprising a second anchor.

5. The expansion device of claim 4, wherein the second anchor is resetable.

6. The expansion device of claim 4, wherein the second anchor is laterally spaced from the resetable anchor.

7. The expansion device of claim 1, wherein the resetable anchor is a one way anchor.

8. The expansion device of claim 7, wherein the one way anchor applies a reaction force to an actuation force of the actuator and is released by a force opposite the actuation force.

9. The expansion device of claim 7, wherein the tubular is a screen.

10. A method of expanding a tubular in a wellbore, the method comprising:
- engaging an anchor at a first location to provide a set anchor; actuating a driver device;
- moving an expansion device relative to the set anchor with the driver device;
- expanding the tubular with the expansion device as the expansion device moves;
- disengaging the anchor;
- moving the anchor to a second location; and
- resetting the anchor, wherein the disengaging and the resetting of the anchor occur in a single trip downhole.

11. The method of claim 10, wherein disengaging the first anchor further comprises moving the anchor in the same direction as the expansion device moves during expansion.

12. The method of claim 10, wherein moving the expansion device with the driver device further comprises applying a pressurized fluid to a piston.

13. The method of claim 10, further comprising expanding the entire length of the tubular.

14. The method of claim 10, wherein the set anchor engages the tubular.

15. An expansion device for radially expanding a tubular in a wellbore, comprising:
- a resetable anchor;
- an expansion cone moveably coupled to the anchor;
- an actuator configured to move the expansion cone relative to the anchor, thereby moving the expansion cone in the tubular in order to radially expand the tubular; and
- a second anchor laterally spaced from the resetable anchor, wherein the second anchor has an outer diameter which is smaller than the outer diameter of the resetable anchor.

16. A method of expanding a tubular in a wellbore, the method comprising:
- engaging an anchor to the tubular at a first location to provide a set anchor;
- actuating a driver device;
- moving an expansion device relative to the set anchor with the driver device;
- expanding the tubular with the expansion device to form an expanded tubular as the expansion device moves;
- disengaging the anchor from the tubular;
- moving the anchor to a second location;
- resetting the anchor; and
- engaging the expanded tubular with a second anchor at a third location.

17. A method of expanding a tubular in a wellbore, the method comprising:
- engaging an anchor to the tubular at a first location to provide a set anchor, wherein the tubular is a screen;
- actuating a driver device;
- moving an expansion device relative to the set anchor with the driver device;
- expanding the tubular with the expansion device as the expansion device moves;
- disengaging the anchor from the tubular;
- moving the anchor to a second location; and
- resetting the anchor.

18. A method of expanding a tubular in a wellbore, the method comprising:
- engaging an anchor to the tubular at a first location to provide a set anchor;
- actuating a driver device;
- moving an expansion device relative to the set anchor with the driver device;

expanding the tubular with the expansion device as the expansion device moves;

disengaging the anchor from the tubular;

moving the anchor to a second location;

resetting the anchor; and circulating a cement into an annulus surrounding the tubular prior to expanding the tubular.

19. The method of claim 18, further comprising anchoring the expanded tubular to the wellbore by curing the cement.

20. An apparatus for radially expanding a tubular, comprising:

an expansion device for radial expansion of the tubular;

an anchor for gripping an expanded inner wall of the tubular;

a driver to provide movement of the expansion device relative the anchor; and at least one wear face of the expansion device wherein the wear face is made of a material harder than a body of the expansion device.

21. The apparatus of claim 20, wherein the body is made of a steel.

22. The apparatus of claim 21, wherein the at least one wear face is made of a tungsten carbide.

* * * * *